US007231720B2

(12) United States Patent
Allen

(10) Patent No.: US 7,231,720 B2
(45) Date of Patent: Jun. 19, 2007

(54) INSIDE/OUTSIDE SCRIBE

(76) Inventor: Robert Thomas Allen, 3179 E. 16th Ave., Vancouver, B.C. (CA) V5M 2M6

( * ) Notice: Subject to any disclaimer, the term of this patent is extended or adjusted under 35 U.S.C. 154(b) by 0 days.

(21) Appl. No.: 11/077,617

(22) Filed: Mar. 11, 2005

(65) Prior Publication Data

US 2005/0155235 A1 Jul. 21, 2005

Related U.S. Application Data

(63) Continuation-in-part of application No. 10/615,940, filed on Jul. 10, 2003, now abandoned.

(51) Int. Cl.
*B43L 13/02* (2006.01)

(52) U.S. Cl. ..... 33/42; 33/41.6; 33/494

(58) Field of Classification Search ..... 33/41.1–41.6, 33/41.7, 42, 44, 494, 483–484, 613, 806
See application file for complete search history.

(56) References Cited

U.S. PATENT DOCUMENTS 41,005 A * 12/1863 Hervey ..... 33/1 G
592,026 A * 10/1897 Staples ..... 33/44
630,248 A * 8/1899 Lynk ..... 33/44
658,881 A * 10/1900 Thompson ..... 33/44
750,221 A * 1/1904 Reis ..... 33/42
985,389 A * 2/1911 Bodmer ..... 33/44
1,515,483 A * 11/1924 Hjert ..... 33/44
1,602,490 A * 10/1926 Homan ..... 33/487
2,774,146 A * 12/1956 McCoy ..... 33/32.2

* cited by examiner

*Primary Examiner*—Yaritza Guadalupe-McCall

(57) ABSTRACT

The invention is an improved, hand-held, adjustable, graduated marking gauge and scribe for carpentry and related activities. It is used to mark work-pieces at a given distance from an adjacent edge or intersecting surface such as is encountered when fitting cabinets or trim to uneven wall surfaces, or in the spiling of boat planking or the marking of cut-outs relative to an edge. The device consists of a main body, upon which are marked scales and which is bent and formed at one end to create an edge follower and a corner follower and upon which is mounted a sliding and stoppable instrument holder which holds marking, cutting or other instruments, inserted therein, in an adjustable fashion. The displacement of the centre-line of the marking instrument relative to the edge follower or the corner follower is read on the scales at the corresponding cursor edge of the instrument holder.

10 Claims, 3 Drawing Sheets

RTA
INCH
CM
PATENT PENDING
MADE IN CANADA
a
a

INSIDE/OUTSIDE SCRIBE

CROSS-REFERENCE TO RELATED APPLICATIONS

This application is a continuation-in-part of prior application Ser. No. 10/615,940, filed Jul. 10, 2003 now abandoned.

STATEMENT REGARDING FEDERALLY SPONSORED RESEARCH DEVELOPMENT

Not applicable

REFERENCE TO SEQUENCE LISTING, A TABLE OR A COMPUTER PROGRAM LISTING COMPACT DISC APPENDIX

Not applicable

BACKGROUND OF THE INVENTION

The invention is a response to the needs of carpenters, building trades technicians and others who need to mark or trim work pieces parallel to either an inside or outside edge. This is exemplified by the scribing process involved in fitting a counter top to an uneven wall or in marking out a border to be painted around the perimeter of a sign.

There are many tools on the market which perform either inside edge marking, scoring or cutting functions, such as the "Adjustable gauge", U.K. Patent number GB2197614, invented by Cryan; Henry Joseph or the tradiditional log scribe type. There are outside edge marking, scoring and cutting tools such as the "Scoring Devise With Edge Guide", U.S. Pat. No. 4,030,195, invented by Insolio; Thomas A. and other traditional mortise gauge type tools. The Inside/Outside Scribe offers the user both inside corner and outside edge marking, scoring and cutting abilty. The invention is also a tool that is compact, cost effective, conveneint and easy to use

SUMMARY OF THE INVENTION

According to one aspect of the present invention there is provided a hand held scribing and gauging tool which has been designed for use by building trades workers to quickly perform marking, scoring or cutting tasks relative to inside corners, such as fitting cabinets or tiles to uneven walls or to mark work pieces relative to outside edges for such functions as blind fastening or painting borders. Marking, scoring or cutting instruments may be used in the tool to perform those functions. The chosen instument is placed in the instrument holder which slides along the body of the tool and is stopped at a given distance from the end of the tool which is either hooked over an edge or butted into a corner and moved along said corner or edge to produce a mark, score or cut line at the desired distance from the corner or edge.

BRIEF DESCRIPTION OF THE DRAWINGS

An example of the present invention will now be described with reference to the accompanying drawings.

DETAILED DESCRIPTION OF THE INVENTION

Figures 1, 2, 3:
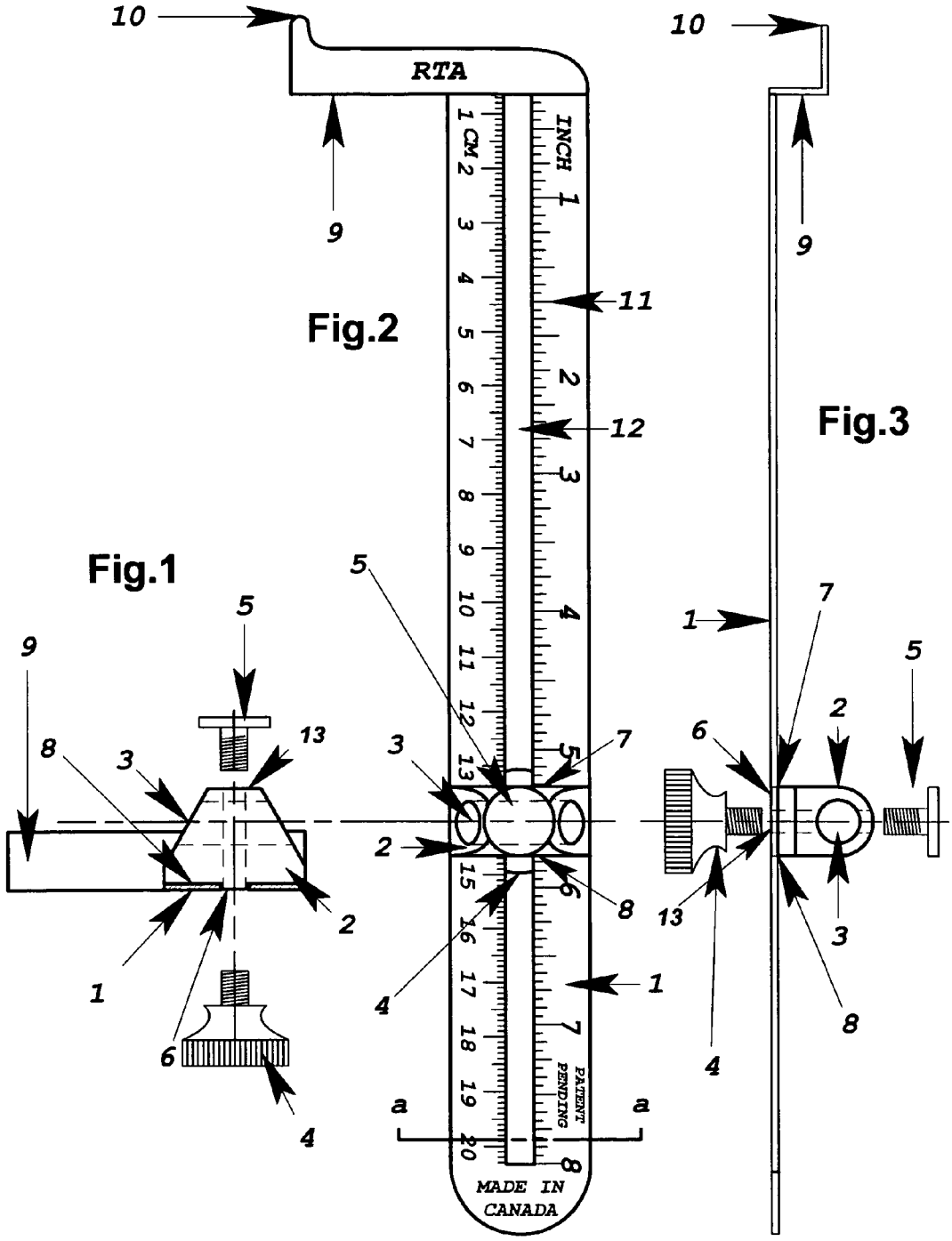
FIG. 1, Cross section of FIG. 2 at aa with thumbscrews aligned.
FIG. 2, Face view of inside/outside scribe body and instrument holder depicting an embodiment of the tool in which the scales are aligned to be read at the two cursor edges.
FIG. 3, Side view of body and end view of instrument holder with thumbscrews aligned.
Figure 4:
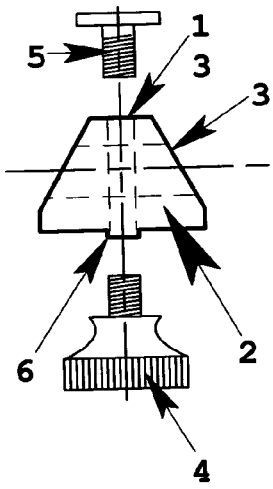
FIG. 4, Side view of instrument holder with aligned thumbscrews.
Figure 5:
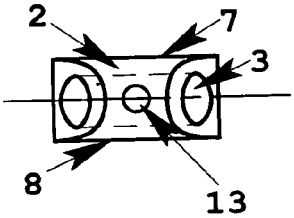
FIG. 5, Top view of instrument holder without thumbscrews.
Figure 6:
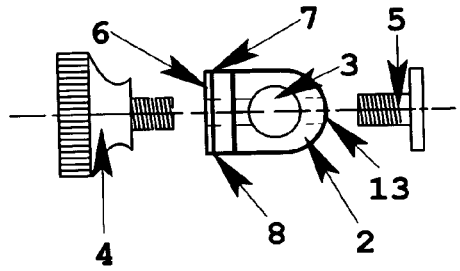
FIG. 6, End view of instrument holder with aligned thumbscrews.
Figure 7:
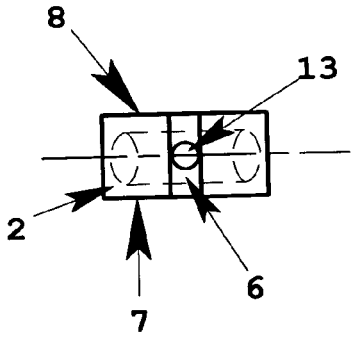
FIG. 7, Bottom view of instument holder without thumbscrews.

Reference will now be made in detail to the present preferred embodiments of the invention, examples of which are illustrated in the accompanying drawings wherein like numerals indicate the same elements throughout the views. The invention disclosed herein may be practiced in embodiments in many different forms and it is understood that the present disclosure is an exemplification of the principles of the invention and does not limit the invention to the illustrated embodiments. Therefore, specific details disclosed herein are not to be interpreted as limiting, but rather as a basis for the claims and as a representative basis for teaching one skilled in the art to employ the present invention.

Referring to FIGS. 1, 2, 3, 4, 5, 6 and 7; In the advantageous embodiment of the inside/outside scribe, as seen in the drawings, the tool consists of an elongate body 1, made of a rugged material such as stainless steel, which is bent and formed at one end thereof, creating an edge follower 9, and a corner follower 10. Upon the body is mounted a sliding and stoppable instrument holder 2, made of suitable material, such as anodised aluminium, which holds, adjustably and releasably, by means of a thumbscrew 5, screwed into threaded hole 13, marking cutting or other instruments which are inserted through hole 3, and adjusted for intended use. Scales 11, are etched into and printed onto the face side of the body 1. The instrument holder 2, is slidably and stoppably mounted on the body 1, by means of a large, machined or cast metal or moulded polymer, (with inserted, threaded metal stud), shouldered thumbscrew 4, which passes through a slot 12, cut out of the body 1 and is screwed into threaded hole 13, of the instrument holder 2. The thickness of the instrument holder 2, is advantageously equal to the distance between the corner follower 10, and the edge follower 9, thereby creating a relationship between the far cursor edge 8, and the corner follower 10, whereby the distance from the corner follower 10, to the centre-line of an instrument being held in hole 3, of the instrument holder 2, can be directly read, adjacent to the far cursor edge 8, on the preferred, etched and inked scale 11, which is aligned to a plane which is at a right angle to the plane of the tool body and laying halfway between the edge follower 9, and the corner follower 10, and represents zero. A corollary relationship therefor exists between the near cursor edge 7, and the edge follower 9, whereby the distance from the edge follower 9, to the centre-line of an instrument mounted in the instrument holder 2, may be directly read on the scale 11, adjacent to the near cursor edge 7. A nub 6, protrudes from the bottom of the instrument holder 2, which acts to align the instrument holder 2, in the slot 12, as it is mounted on the body 1. A plane formed by the centre-line of the held instrument and the corner follower 10, is roughly parallel to the main portion of the body, insuring relative accuracy of performance as the tool may be held at an approximate right angle to straight corners and edges and normal to curved corners and edges.

Figure 8:
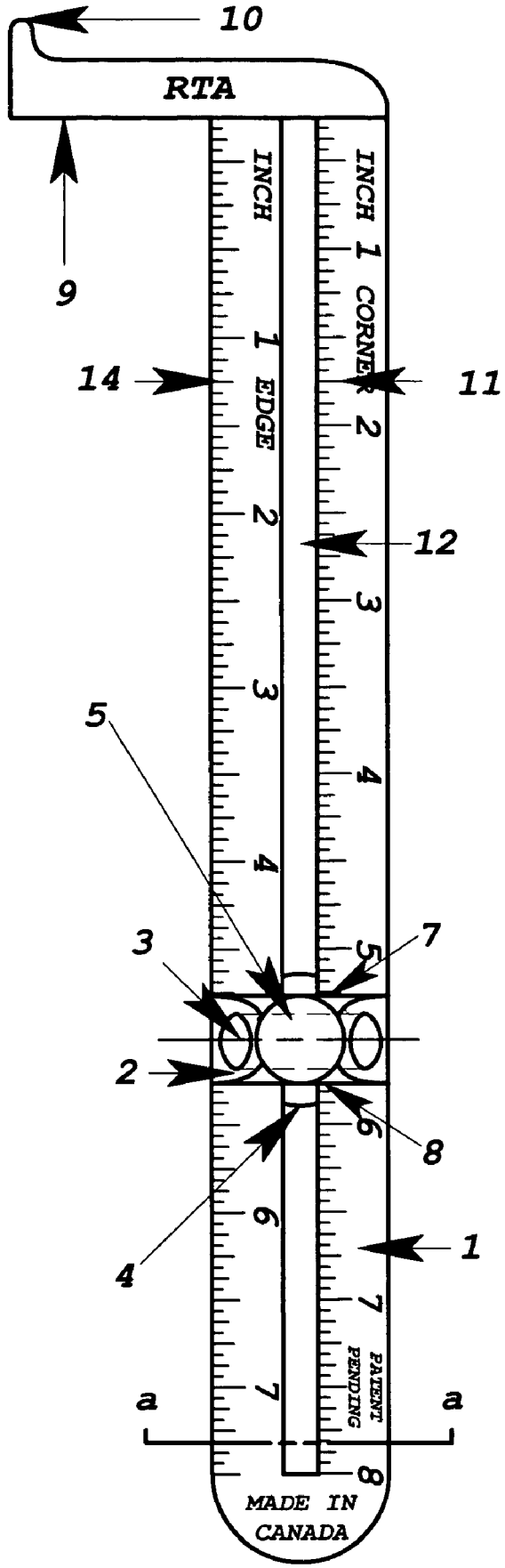
FIG. 8. Face view of inside/outside scribe body and instrument holder depicting an embodiment of the tool in which the scales are aligned to be read at only one cursor edge.

Referring to FIG. 8; In the alternatively advantageous imbodiment of the inside/outside scribe, as seen in the drawing, the tool is as described above with the exception that the zero plane of scale 14, is offset longitudinally from the zero plane of scale 11, by the same distance that the corner follower 10, is displaced longitudinally from the edge follower 9.

As will be apparent to those skilled in the art, various modifications and adaptations are possible in the practice of this invention without departing from the spirit or scope thereof. Accordingly, the scope of the invention is to be construed in accordance with the substance defined by the following claims.

I claim as my invention:

1. A hand tool for scribing, marking or cutting materials, the tool comprising:

an elongate body;

an analog member connected to one end of the body, the analog member comprising a corner follower and an edge follower that is longitudinally displaced from the corner follower whereby the tool is able to perform the dual functions of following either an inside corner or an outside edge;

first and second scales of a standard unit of measure marked longitudinally on the elongate body wherein a zero index of the first scale corresponds with the corner follower and a zero index of the second scale corresponds with the edge follower such that the zero index of the first scale is longitudinally displaced from the zero index of the second scale on the elongate body by a distance equal to the longitudinal displacement between the corner follower and the edge follower, and an instrument holder which is slidably and stopably mounted on the body and having a cursor for indicating with reference to the first scale the distance between the corner follower and an instrument held in the instrument holder during use of the tool, and with reference to the second scale the distance between the edge follower and the instrument.

2. The tool as claimed in claim 1 wherein the elongate body is planar and the analog member and the instrument are each offset from the plane of the elongate body.

3. The tool as claimed in claim 2 wherein the offset distance of the analog member from the plane of the elongate member is equal to the offset distance of the instrument from the plane of the elongate member.

4. A hand tool for scribing, marking or cutting materials, the tool comprising:

an elongate body having a scale of units of measure marked longitudinally thereon;

an analog member connected to one end of me body, the analog member comprising a corner follower and an edge follower that is longitudinally displaced from the corner follower whereby the tool is able to perform the dual functions of following either an inside corner or an outside edge; and an instrument holder which is slidably and stopably mounted on the body and having a near cursor for indicating with reference to the scale the distance between the edge follower and an instrument held in the instrument holder during use of the tool, and a far cursor longitudinally displaced from the near cursor for indicating with reference to the scale the distance between the corner follower and me instrument, wherein the longitudinal displacement between the near cursor and far cursor is equal to the longitudinal displacement between the corner follower and edge follower.

5. The tool as claimed in claim 4 wherein the near cursor is closer to the analog member than the instrument and the far cursor is farther from the analog member than the instrument.

6. The tool as claimed in claim 5 wherein;

the scale is positioned longitudinally along the elongate body such that its zero index is, or would be if marked, between the corner follower and the edge follower;

the longitudinal distance between the edge follower and the zero index is equal to the longitudinal distance between the far cursor and the instrument; and the longitudinal distance between the corner follower and the zero index is equal to the longitudinal distance between the near cursor and the instrument, thereby allowing the user to read the position of instrument relative to either the inside or outside follower from the same scale.

7. The tool as claimed in claim 6 wherein the zero index is equidistant from the corner follower and edge follower.

8. The tool as claimed in claim 7 wherein the cursors are defined by respective edges of the instrument holder.

9. The tool as claimed in claim 8 wherein the elongate body is planar, and the analog member and the instrument are each offset from the plane of the elongate body.

10. The tool as claimed in claim 8 wherein the offset distance of the analog member from the plane of the elongate member is equal to the offset distance of the instrument from the plane of the elongate member.

* * * * *